US006850213B2

(12) United States Patent
Marcotte

(10) Patent No.: US 6,850,213 B2
(45) Date of Patent: Feb. 1, 2005

(54) ENERGY RECOVERY CIRCUIT FOR DRIVING A CAPACITIVE LOAD

(75) Inventor: Robert G. Marcotte, New Paltz, NY (US)

(73) Assignee: Matsushita Electric Industrial Co., Ltd., Takatsuki (JP)

( * ) Notice: Subject to any disclaimer, the term of this patent is extended or adjusted under 35 U.S.C. 154(b) by 217 days.

(21) Appl. No.: 10/039,605

(22) Filed: Nov. 9, 2001

(65) Prior Publication Data

US 2003/0090440 A1 May 15, 2003

(51) Int. Cl.[7] ..... G09G 3/28

(52) U.S. Cl. ..... 345/60; 345/63; 345/66; 345/67; 345/68; 315/169.4

(58) Field of Search ..... 345/60, 63, 66–70; 315/169.4

(56) References Cited

U.S. PATENT DOCUMENTS

| | | | | |
|---|---|---|---|---|
| 3,559,190 | A | 1/1971 | Bitzer et al. | 365/116 |
| 4,772,884 | A | 9/1988 | Weber et al. | 340/776 |
| 5,081,400 | A | 1/1992 | Weber et al. | 315/169.4 |
| 5,227,696 | A | 7/1993 | Asars | 315/169.3 |
| 5,642,018 | A | 6/1997 | Marcotte | 315/169.4 |
| 5,786,794 | A | 7/1998 | Kishi et al. | 345/60 |
| 5,828,353 | A | 10/1998 | Kishi et al. | 345/55 |
| 5,943,030 | A | 8/1999 | Minamibayashi | 345/60 |
| 5,994,929 | A | 11/1999 | Sano et al. | 327/111 |
| 6,011,355 | A | 1/2000 | Nagai | 315/167.3 |
| 6,028,573 | A | 2/2000 | Orita et al. | 345/66 |
| 6,057,815 | A | 5/2000 | Sano | 345/60 |
| 6,111,556 | A | 8/2000 | Moon | 345/60 |
| 6,211,867 | B1 | 4/2001 | Kim | 345/211 |

FOREIGN PATENT DOCUMENTS

| | | | |
|---|---|---|---|
| WO | WO 02/39419 | 5/2002 | G09G/3/28 |

*Primary Examiner*—Jimmy H. Nguyen
(74) *Attorney, Agent, or Firm*—Ohlandt, Greeley, Ruggiero & Perle, LLP

(57) ABSTRACT

A circuit for providing a pulse to drive a capacitive load comprises (a) a first inductive component that influences both a transition time of a rising edge of the pulse and a transition time of a falling edge of the pulse, and (b) a second inductive component that influences one of the transition time of the rising edge and the transition time of the falling edge so that the rising edge and the falling edge are asymmetrical.

15 Claims, 12 Drawing Sheets

ENERGY RECOVERY CIRCUIT FOR DRIVING A CAPACITIVE LOAD

BACKGROUND OF THE INVENTION

1. Field of the Invention

The present invention relates to a sustain signal driver circuit for a capacitive display panel and, more particularly, to a sustain signal driver circuit for minimizing power loss when driving a capacitive load.

2. Description of the Prior Art

Plasma display panels (PDPs) are well known in the art and include a front plate with horizontal electrode pairs having a capacitance there between. The electrode pairs are covered by a glass dielectric layer and a magnesium oxide (MgO) layer. A back plate supports vertical barrier ribs and plural vertical column electrodes. The individual column electrodes are covered with red, green, or blue phosphors, as the case may be, to provide for a full color display. The front and rear plates are sealed together and the space there between is filled with an electrically dischargeable gas.

A pixel is defined by an intersection of an electrode pair on the front plate and three column electrodes for red, green, and blue, respectively, on the back plate. The electrode pair on the front panel has a region of overlap therebetween. The width of the electrode pair and the thickness of the dielectric glass over the electrode pair determine the pixel's discharge capacitance, which in turn influences the discharge power and therefore the brightness of the pixel. A number of discharges are controlled to provide a desired brightness for the panel.

Detailed descriptions of the structure and operation of gas discharge panels are set forth in U.S. Pat. No. 3,559,190 to Bitzer, et al. and in U.S. Pat. No. 4,772,884 to Weber et al.

The typical operation of an AC plasma display involves applying alternating sustain pulses to the front panel electrode pair. Each sustain pulse consists of a positive going resonant transition, activation of a pull up driver to source a gas discharge current, a negative going resonant transition, and activation of a pull down driver. The sustain pulse is applied to a first one of the electrodes in the pair, and then, the same sequence is applied to the second electrode in the pair. The gas discharge occurs at the completion of the rising transition.

Display devices such as plasma displays require high speed charging and discharging of the capacitive loads of the pixels with relatively high voltages, e.g., 50 to 200 volts, over a broad range of frequencies, e.g., 10 KHz to 500 KHz. Energy recovery sustainers have been developed for plasma displays to enable recovery of energy used to charge and discharge a panel's capacitance. As AC plasma displays have grown in size and as operating voltages have increased, the needs of increased switching efficiency and precise control of the turn-on of output drivers has become critical.

U.S. Pat. No. 5,081,400 to Weber et al. (hereinafter "the Weber et al. '400 patent") discloses an energy recovery circuit. U.S. Pat. No. 5,642,018 to Marcotte (hereinafter "the Marcotte '018patent") discloses using a signal derived from an energy recovery inductor to precisely control the turn-on of the output drivers for an energy recovery circuit.

U.S. Pat. No. 5,828,353 to Kishi et al. discloses a circuit for producing a pulse having asymmetrical rising and falling transistions. The circuit includes an application inductor in parallel with a recovery inductor. The application inductor influences only the rising transition, and the recovery inductor influences only the falling transition.

With regard to a switch or transistor as described herein, the terms "closed" and "on" correspond to a state where current can be conducted through the switch or transistor, and the terms "open" and "off" correspond to a state where current cannot be conducted through the switch or transistor.

FIG. 1 shows an idealized schematic of a circuit that includes a prior art sustain driver 100. Sustain driver 100 includes four switches, S1, S2, S3 and S4, which are controlled so that sustain driver 100 progresses through four successive switching states, i.e., State 1, State 2, State 3 and State 4. Sustain driver 100 outputs a sustain pulse, which is represented as a panel voltage Vp.

A control signal is provided from a source as in input to sustain driver 100 to control the progression of States 1–4. The control signal is a logic level signal, e.g., 0–5 volts, having a leading rising edge and a lagging falling edge. Each idealized circuit described herein, e.g., sustain driver 100 in FIG. 1, is driven by such a control signal, but the source is shown only in the detailed circuit views, e.g., source 12 in FIG. 3.

FIG. 2 shows, for the circuit of FIG. 1, a waveform of voltage Vp and a waveform of a current $I_L$ through an inductor L. The waveforms of FIG. 2 are those expected as switches S1–S4 are opened and closed through the progression of States 1–4.

Sustain driver 100 operates with a power supply voltage Vcc. Assume that prior to State 1 a recovery voltage Vss is at Vcc/2, Vp is at zero, S1 and S3 are open, and S2 and S4 are closed. A capacitance Cp is the panel capacitance as seen by sustain driver 100. A recovery capacitance Css must be much greater than Cp to minimize a variation of Vss during States 1 and 3. The reason that Vss is at Vcc/2 will be explained, below, after the switching operation is explained.

State 1. S1 is closed, S2 is opened, S3 remains open, as it was prior to State 1, and S4 is opened. With S1 closed, a diode D1 is forward biased. Inductor L and Cp form a series resonant circuit, and a "forcing" voltage of Vss=Vcc/2 is applied across L and Cp. During State 1, current $I_L$ charges Cp so that Vp rises to Vcc as energy is transferred from Css to Cp. By the end of State 1, $I_L$ falls to zero, and diode D1 becomes reverse biased. In State 1, sustain driver 100 provides a leading rising edge of the sustain pulse.

State 2. S3 is closed. Through S3, Vp is clamped at Vcc and a current path is provided from Vcc for any "ON" pixels in the panel. When a pixel is in the ON state, its periodic discharges provide a substantial short circuit across an ionized gas. The current required to maintain the discharge is supplied from Vcc. The discharge/conduction state of a pixel is represented by icon 10.

State 3. S1 is opened, S2 is closed, and S3 is opened. With S2 closed, D2 is forward biased and inductor L and capacitance Cp again form a series resonant circuit, with the voltage across inductor L equal to Vss=Vcc/2. However the polarity of the voltage across L is reverse as compared to that of State 1, causing a negative flow of current $I_L$. During State 3 Vp then falls to ground as energy previously stored in inductor L is returned to Css. By the end of State 3, $I_L$ reaches zero, and D2 becomes reverse biased. In State 3, sustain driver 100 provides a falling, lagging edge of the sustain pulse.

State 4. S4 is closed. Through S4, Vp is clamped to ground. On the opposite side of the plasma panel, another sustain driver 105, which is identical to sustain driver 100, drives the opposite side of the panel to Vcc. If any pixels are "ON", then a discharge current flows through S4.

It was assumed above that Vss remains stable at Vcc/2 during charging and discharging of Cp. The reasons for this are as follows. If Vss were less than Vcc/2, then on the rise of Vp, when S1 is closed, the forcing voltage would be less than Vcc/2. Subsequently, on the fall of Vp, when S2 is closed, the forcing voltage would be greater than Vcc/2. Therefore, on average, current would flow into Css. Conversely, if Vss were greater than Vcc/2, then on average, current would flow out of Css. Thus, the stable voltage at which the net current into Css is zero, is Vcc/2. In fact, on power up, as Vcc rises, if sustain driver 100 is continuously switched through the four states described above, then Vss will rise, with Vcc, to Vcc/2.

FIG. 3 is a schematic of a sustain driver 300, which serves as an exemplary implementation of the idealized circuit of FIG. 1. FIG. 4 is a timing diagram for several of the waveforms for sustain driver 300.

In FIG. 3, four transistors, T1, T2, T3 and T4, replace switches S1, S2, S3 and S4, respectively, of FIG. 1. A zener diode Z1 is connected to a node VG1 at a gate of transistor T1 to protect transistor T1. Likewise, zener diodes Z2 and Z3 are connected at nodes VG2 and VG3 to protect transistors T2 and T3. Transistors T1 and T3 have P-channels, and thus are turned on when a falling edge signal is provided at their gates. Transistors T2 and T4 have N-channels, and thus are turned on when a rising edge signal is provided at their gates.

A first driver, Driver 1, produces a signal that is coupled through a capacitor Cg1 to node VG3 to control transistor T1, and through a capacitor Cg2 to control transistor T2. T1 and T2 operate in a complementary fashion so that when T1 is on, T2 is off and vice-versa. A second driver, Driver 2, uses either a time constant of a resistor R1 and a capacitor C3, or a voltage fall at a node V1, to turn on transistor T4. Similarly, a third driver, Driver 3, uses either a time constant of a resistor R2 and a capacitor C4, or a voltage rise at a node V2, and provides a signal that is coupled through a capacitor Cg3 to turn on transistor T3. Two diodes, D3 and D4, are used to quickly turn off transistors T3 and T4. A generic driver 305 is shown to represent a typical internal configuration of Driver 1, Driver 2 and Driver 3.

State 1. A source 12 provides a control signal such that T1 is turned on and T2 is turned off. T3 is waiting to be turned on by the R2-C4 time constant or by the rise of voltage at node V2. T4 is turned off.

Through T1, Vss is applied to nodes V1 and A. Inductor L and panel capacitance Cp form a series resonant circuit that has a forcing voltage of Vss=Vcc/2. As a result of energy stored in inductor L, Vp rises past Vss approaching Vcc, at which point $I_L$ goes to zero.

Since Vp typically rises to 80% of Vcc, inductor L thereafter sees a forcing voltage, from the panel side, of Vp minus Vss. Negative current $I_L$ now flows out of the panel, back through inductor L, reverse biases D1 and charges the capacitance of T2. This reverse current, also known as flyback current, starts at time t1 in FIG. 4. A first flyback current causes a voltage flyback at nodes A and V2 to rise sharply. As the voltage at node V2 rises, C4 couples this rise to trigger Driver 3 to turn on T3.

The panel voltage Vp drops as energy is taken out of the panel by the flyback current and put back into inductor L between times t1 and t2. This energy, also known as flyback energy, is dissipated in T3, L, D2, and a diode DC2.

State 2. T3 is turned on to clamp Vp at Vcc and to provide a current path for any discharging "ON" pixel. Since energy was put into inductor L, negative current $I_L$ continues to flow from T3, and through inductor L, diode D2 and diode DC2, until the energy is dissipated. All of the aforesaid components are low loss components so the current decay is slow.

State 3. Source 12 provides the control signal such that T1 is turned off, T2 is turned on, T3 is turned off, and T4 remains off. Vp is approximately at Vcc, as panel capacitance Cp is fully charged. With T2 on, inductor L and panel capacitance Cp again form a series resonant circuit having a forcing voltage across inductor L of Vss=Vcc/2. As a result of energy stored in the inductor, Vp falls past Vss approaching ground, at which point $I_L$ is zero.

Since Vp typically falls to 20% of Vcc, inductor L thereafter sees a forcing voltage, toward the panel side, of Vss minus Vd. Positive current $I_L$ now flows out towards the panel drawing current through the inductor L, reverse biases diode D2 and discharges the capacitance of T1, pulling node V1 sharply to ground. A second flyback current through inductor L occurs at time t3 and is coupled through C3 to Driver 2, which turns on T4.

State 4. T4 clamps Vp to ground. On the opposite side of the plasma panel, another sustain driver (not shown in FIG. 3), which is identical to sustain driver 300, drives the opposite side of the panel to Vcc. If any pixels are "ON", then a discharge current flows through T4.

FIG. 5 illustrates a sustain driver 500, which is disclosed in the Marcotte '018 patent as an improvement over sustain driver 100 of FIG. 1. FIG. 6 is a waveform diagram illustrating the operation of sustain driver 500.

In FIG. 5, a control network 20 has been added and is coupled to inductor L via a secondary winding 22. Control network 20 controls the conductivity states of switches S3 and S4. Control network 20 uses the voltage across inductor L (and secondary winding 22) to slowly close the output switch S3 after the output has risen past its halfway point. On the fall, switch S4 is slowly closed after the output descends past the halfway point. Diode DC2 and resistor R2 dampen one polarity of flyback current and a diode DC1 and resistor R1 dampen the opposite polarity flyback current. The conductivity states of S1 and S2 are controlled by circuitry (not shown in FIG. 5) that is responsive to input rise and fall of a logic control signal.

The operation of the four switching states of sustain driver 500 and timing diagrams of FIG. 6 are explained in detail below, where it is assumed that prior to State 1, the recovery voltage, Vss, is at Vcc/2, where Vcc is the sustain power supply voltage, Vp is at zero, S1 and S3 are open, and S2 and S4 are closed.

State 1. Switches S2 and S4 are opened, and switch S1 is closed. Vss is applied to node A. The voltage at node A is represented as voltage $V_A$. Vc is the voltage across inductor L, i.e.,$Vc=VP-V_A$. Since the current through inductor L is proportional to a time integral of the voltage across inductor L, current $I_L$ increases for the first half of State 1 and then decreases as panel voltage Vp rises above recovery voltage Vss, during the second half of State 1. Control network 20 senses across secondary winding 22, a voltage Vc', which is proportional to Vc, and allows switch S3 to be turned on only after Vp has crossed Vss, the half-way point, and then only during the rise of Vp. In an ideal case, S3 is closed at the positive peak of Vc, time t1 and the instant the inductor L current $I_L$ equals zero (see FIG. 6). Briefly stated, S3 is to be closed and ready for full conduction when $I_L$ falls to zero at the end of State 1. This action enables the following flyback current through inductor L to be drawn from the Vcc supply, through S3, and not from the panel.

State 2. S1 and S3 remain closed, allowing S3 to be the source of both the current to sustain discharges in the panel and the flyback current that flows through inductor L. The flyback current brings voltage $V_A$ at node A up to Vcc. The energy induced into inductor L by the flyback current is dissipated by conduction through diodes D2, DC2 and resistor R2. The value of resistor R2 is chosen to dissipate the flyback energy before State 3.

State 3. S1 and S3 are opened, S4 remains open, and S2 is closed, bringing voltage $V_A$ at node A down to Vss. Vp is now greater than $V_A$, causing negative current $I_L$ to flow proportional to the time integral of the voltage Vc across inductor L. Once the falling voltage Vp crosses the half-way point, Vc reverses polarity and control network 22 turns on switch S4 at the negative peak of Vc at time t3 in a manner similar to that described above for State 1.

State 4. S4 is closed while a second sustain driver 505 on the opposite side of the panel produces a sustain pulse that rises, discharges, and falls since S4 is part of the return path for the second sustain driver. When the voltage flyback occurs, the flyback current is drawn from S4 rather than from the panel, and returns the voltage Vc back to zero.

The energy recovery circuits disclosed in the Weber et al. '400 and Marcotte '018 patents employ a single resonant inductance, and therefore, these circuits provide sustain pulses that have symmetrical rise and fall times. As the gas discharge occurs at the completion of the rising transition, the rising transition must be fast and the turn-on of the pull up driver must be fully ON before the discharge occurs. However, the falling transition does not produce a discharge and the energy recovery efficiency of the panel can be increased if the edge rate is reduced. Nevertheless, the turn on timing of the pull down driver influences the efficiency of the panel and the generation of electrical noise.

There is a need for a circuit that provides for a PDP sustain pulse having a rise time that is not necessarily symmetrical to its fall time.

SUMMARY OF THE INVENTION

It is an object of the present invention to provide an improved circuit for providing a pulse to drive a capacitive load.

It is another object of the present invention to provide such a circuit where the pulse has a rise time and a fall time that are asymmetrical.

It is a further object of the present invention to provide such a circuit that recovers energy when employed to drive a plasma display panel.

These and other objects of the present invention are achieved by a circuit for providing a pulse to drive a capacitive load. The circuit comprises (a) a first inductive component that influences both a transition time of a rising edge of the pulse and a transition time of a falling edge of the pulse, and (b) a second inductive component that influences one of the transition time of the rising edge and the transition time of the falling edge so that the rising edge and the falling edge are asymmetrical.

Rise and fall transition times are controlled by a resonance of an inductance with the load capacitance. An arrangement of switching devices initiates the transitions and provides output drive to fixed power supply rails.

The present invention improves on the design disclosed in the Marcotte '018 patent by adding a second inductor in series with the original inductor such that current during the rise flows through the original inductor, and current for the fall flows through the original inductor and the second inductor. For the fall, the sum of the inductances of the two inductors provides a longer falling transition time. The secondary windings described by the Marcotte '018 patent may be placed on the original inductor for the precise control of the pull up and pull down drivers respectively. Optionally, the secondary winding used for the pull down driver may be placed the second inductor.

Another embodiment of the invention provides a slower rise time with a longer fall time.

DESCRIPTION OF THE INVENTION

Figure 7:
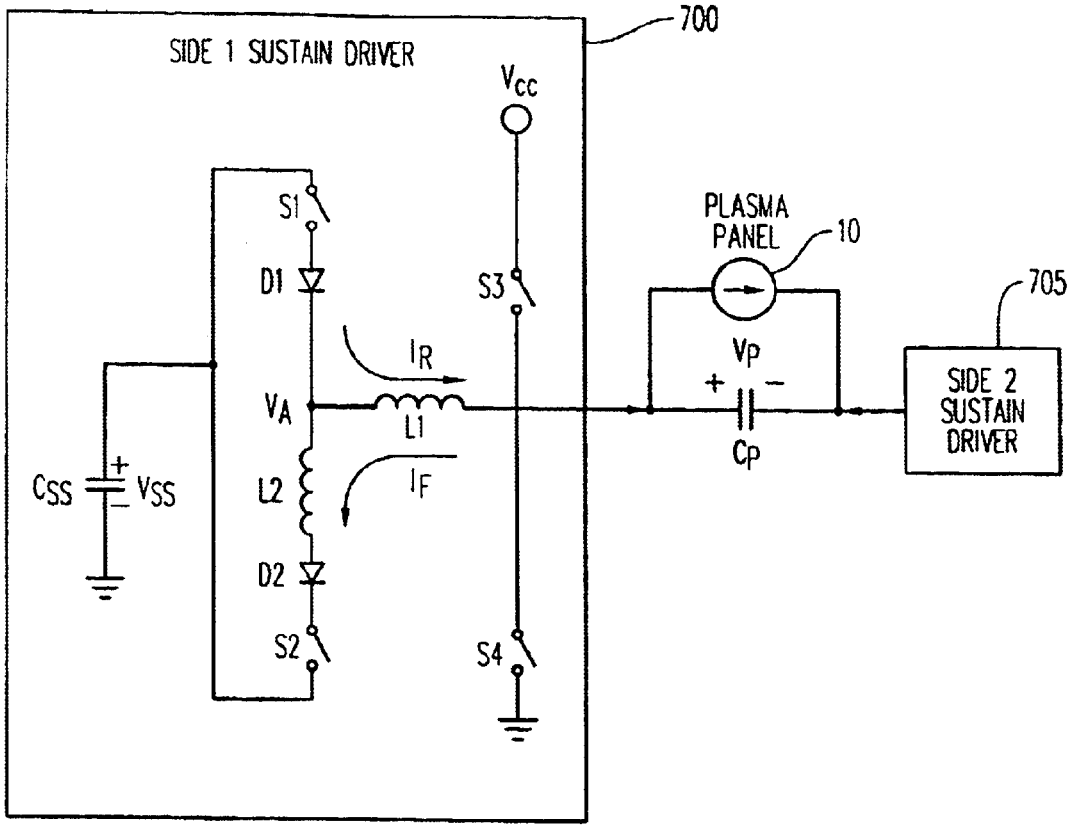
FIG. 7 is an idealized schematic of a sustain driver in accordance with the present invention.

FIG. 7 is an idealized schematic of a sustain driver 700, in accordance with the present invention, for a plasma display panel. The principal components of sustain driver 700 are four switching devices, i.e., switches, S1, S2, S3 and S4 and two inductive components, i.e., inductors L1 and L2. A control signal is provided from a source (not shown in FIG. 7) to control switches S1–S4 so that sustain driver 700 progresses through four successive switching states, i.e., State 1, State 2, State 3 and State 4. Sustain driver 700 outputs a sustain pulse, which is represented as a panel voltage Vp.

L1 influences both a transition time of a rising edge of the sustain pulse and a transition time of a falling edge of the sustain pulse. L1 and L2 influence the transition time of the falling edge so that the rising edge and the falling edge are asymmetrical. A first current flows through L1 to produce the rising edge, and a second current flows through both of L1 and L2 to produce the falling edge. S1 enables and disables a path for the first current, and S2 enables and disables a path for the second current.

A capacitance Cp is the panel capacitance as seen by sustain driver 700. A recovery capacitance Css must be much greater than Cp to minimize a variation of Vss during States 1 and 3. Sustain driver 700 operates with a power supply voltage Vcc.

Figure 8:
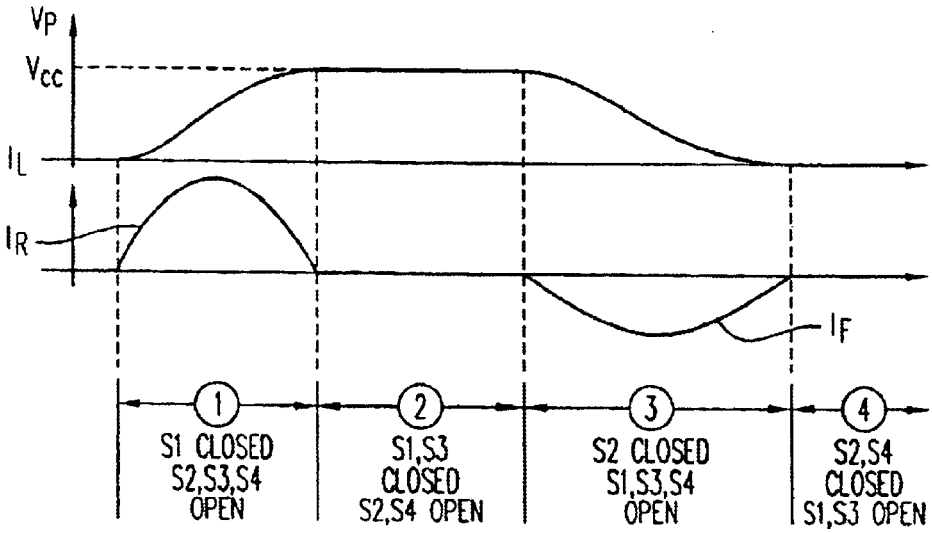
FIG. 8 is a waveform diagram illustrating the operation of the circuit of FIG. 7.

FIG. 8 shows, for the circuit of FIG. 7, a waveform of voltage Vp, a waveform of a current $I_L$ through inductor L1. The waveforms of FIG. 8 are those expected as switches S1–S4 are opened and closed through the progression of States 1–4.

Note that current $I_L$ has two components. The first component, represented in State 1, is a current $I_R$, which flows through inductor L1 during a rising edge of a sustain pulse. The second component, represented in State 3, is a current $I_F$, which flows through inductors L1 and L2 during a falling edge of the sustain pulse.

Assume that prior to State 1 a recovery voltage Vss is at Vcc/2, Vp is at zero, S1 and S3 are open, and S2 and S4 are closed.

State 1. S1 is closed, S2 is opened, S3 remains open, as it was prior to State 1, and S4 is opened. With S1 closed, a diode D1 is forward biased and current $I_R$ flows through inductor L1 to the panel. Inductor L1 and Cp form a series resonant circuit, and a "forcing" voltage of Vss=Vcc/2 is applied. During State 1, current $I_R$ charges Cp so that Vp rises to Vcc. By the end of State 1, $I_L$ falls to zero, and diode D1 becomes reverse biased. In State 1, sustain driver 700 provides the leading rising edge of the sustain pulse.

State 2. S1 remains closed, S2 remains open, S3 is closed, and S4 remains open. Through S3, Vp is clamped at Vcc and a current path is provided from Vcc for any "ON" pixels in the panel. The current required to maintain the discharge of the ON pixels is supplied from Vcc. The discharge/conduction state of a pixel is represented by icon 10.

State 3. S1 is opened, S2 is closed, S3 is opened, and S4 remains open. With S2 closed, D2 is forward biased and inductor L2 is placed in series with inductor L1 and capacitance Cp. L2, L1 and Cp form a series resonant circuit. The polarity of the voltage across L is reverse as compared to that of State 1, and thus current $I_F$ flows in a direction opposite to that of $I_R$ in State 1. During State 3 Vp then falls approaching ground as energy stored in inductors L1 and L2 is recovered in Css. By the end of State 3, $I_F$ reaches zero, and D2 becomes reverse biased. In State 3, sustain driver 700 provides a falling, lagging edge of the sustain pulse.

State 4. S4 is closed. Through S4, Vp is clamped to ground. On the opposite side of the plasma panel, another sustain driver 705, which is identical to sustain driver 700, drives the opposite side of the panel to Vcc. If any pixels are "ON", then a discharge current flows through S4.

Note that S2 is closed, and that a current flows through D2 and L2 only during State 3, that is, during the failing edge of the sustain pulse. Thus, L2 has no impact on the rising edge of the sustain pulse.

FIG. 8 shows the effect of the increased inductance, i.e., the combined inductance of L1 and L2, during the falling transition in State 3. Since the panel capacitance Cp is unchanged, the increased inductance results in a current $I_F$ having a reduced amplitude and a longer duration than that of $I_R$.

Figure 9:
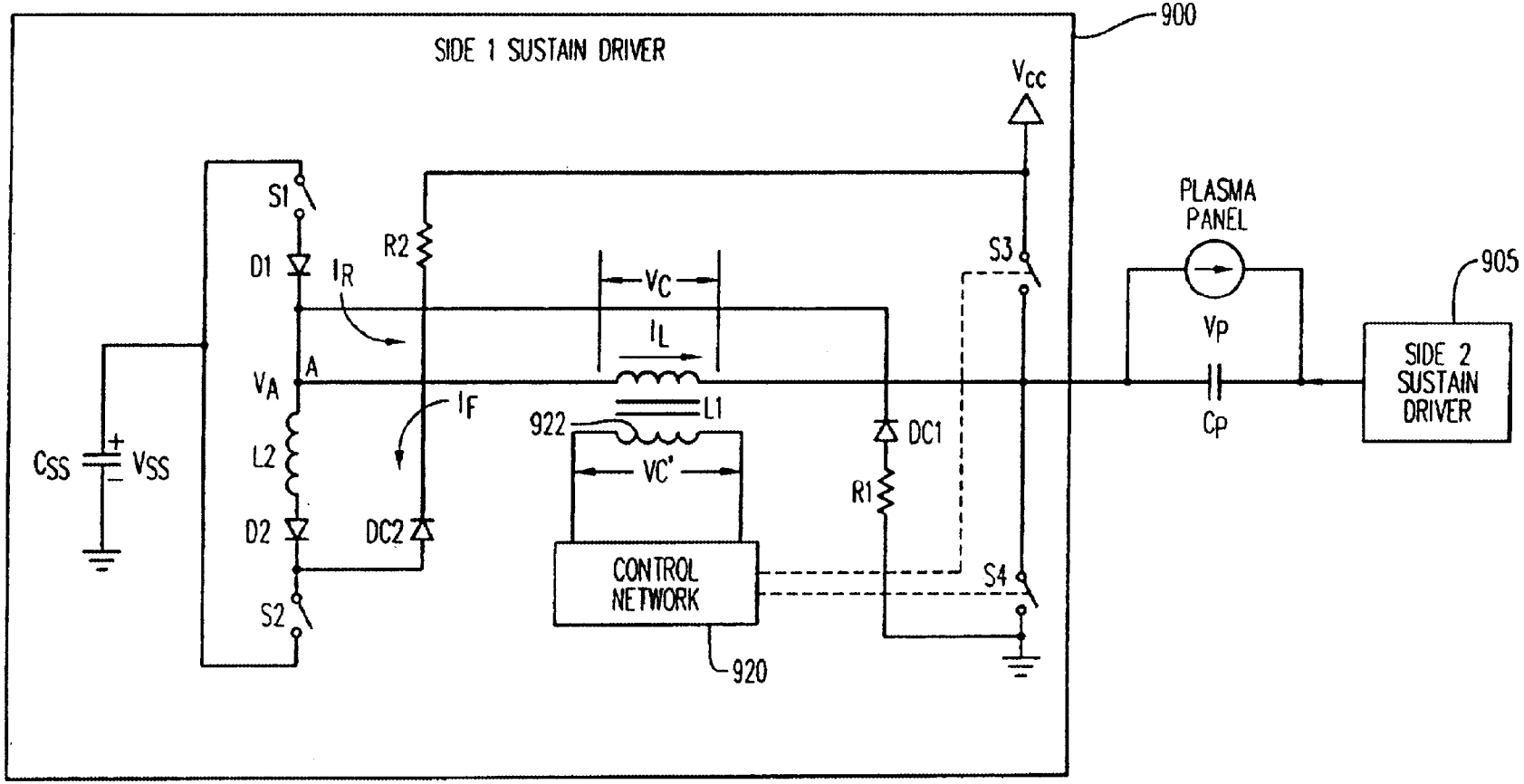
FIG. 9 is an idealized schematic of a sustain driver that improves on the design of the sustain driver shown in FIG. 7.
Figure 10:
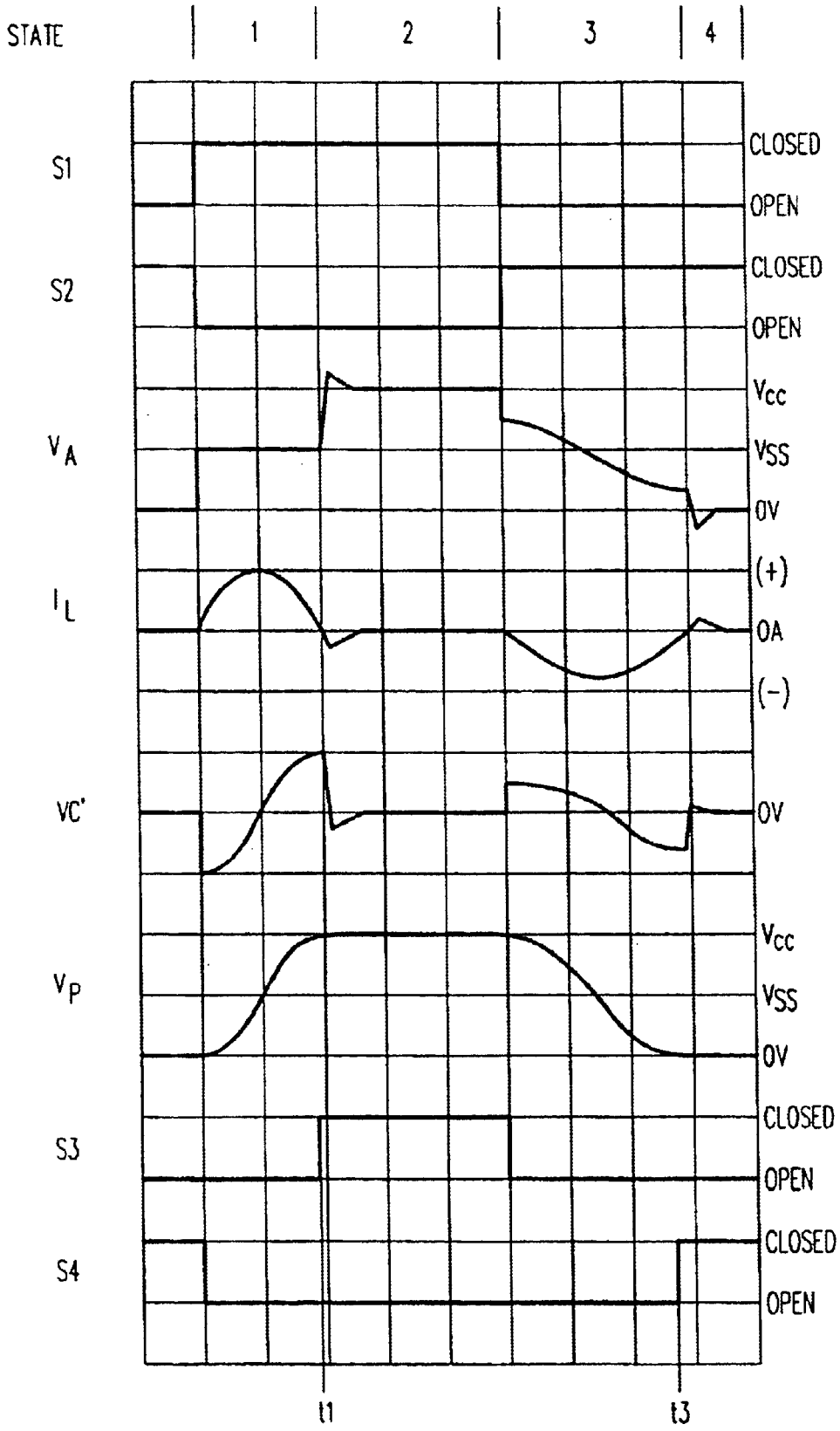
FIG. 10 is a waveform diagram illustrating the operation of the sustain driver of FIG. 9.

FIG. 9 is an idealized schematic of a sustain driver 900, which improves on the design of sustain driver 700, shown in FIG. 7. FIG. 10 is a waveform diagram illustrating the operation of sustain driver 900.

In FIG. 9, a control network 920 has been added and is inductively coupled to inductor L1 via a secondary winding 922. Control network 920 controls the conductivity states of switches S3 and S4. A voltage Vc' across secondary winding 922 is proportional to the voltage Vc across inductor L1. Control network 920 senses voltage Vc' and slowly closes the output switch S3 after the panel voltage Vp has risen past its halfway point. Based on its sensing of voltage Vc', control network 920 detects the trailing edge of the $I_F$ component of $I_L$ and controls switch S4 so that it is slowly closed after the panel voltage Vp descends past the halfway point. Diode DC2 and resistor R2 dampen one polarity of flyback current and diode DC1 and resistor R1 dampen the opposite polarity flyback current. The conductivity states of S1 and S2 are controlled by circuitry (not shown in FIG. 9) that is responsive to input rise and fall of a logic control signal. The operation of the four switching states of sustain driver 900 and timing diagrams of FIG. 10 are explained in detail below.

It is assumed that prior to State 1, the recovery voltage, Vss, is at Vcc/2, where Vcc is the sustain power supply voltage, Vp is at zero, S1 is open, S2 is closed, S3 is open, and S4 is closed.

State 1. S1 is closed, S2 is opened, S3 remains open, and S4 is opened. Vss is applied to node A. The voltage at node A is represented as voltage $V_A$. Vc is the voltage across inductor L1, i.e., $Vc=VP-V_A$. Since the current through inductor L1 is proportional to a time integral of the voltage across inductor L1, current $I_L$ increases for the first half of State 1 and then decreases during the second half of State 1 as panel voltage Vp rises above recovery voltage Vss. Control network 920 senses, across secondary winding 922, a voltage Vc', which is proportional to Vc, and controls switch S3 to be turned on, i.e., closed, only after Vp has crossed Vss, the half-way point, and then only during the rise of Vp. In an ideal case, S3 is closed at the positive peak of Vc, time t1, and the instant current $I_L$ equals zero (see FIG. 10). Briefly stated, S3 is to be closed and ready for full conduction when $I_L$ falls to zero at the end of State 1.

In a practical case, sensing the half-way point allows the circuitry to begin closing switch S3 prior to the inductor current $I_L$ reaching zero, which allows switch S3 to begin sourcing current as current through inductor L1 approaches zero. This permits the panel voltage to reach Vcc before any discharge or flyback current is drawn. As such the panel voltage Vp is prevented from dropping below Vcc as a result of gas discharge current, and the stated first flyback current. This improves panel operating voltage margin and reduces electromagnetic interference (EMI).

State 2. S1 remains closed, S2 remains open, S3 remains closed, and S4 remains open. As the inductor current L1 approaches zero, the inductor sees a forcing voltage, from the panel side, of Vp minus Vss, where Vp is equal to Vcc due to S3 being closed. The first flyback current now flows from the panel side through S3 through L1, reverse biasing D1, charges the capacitance of node A and through L2 and D2 charges the capacitance of S2. During state 2, switch S3 allows Vcc, to source both the current to sustain discharges in the panel and the flyback current that flows through inductors L1 and L2. The energy induced into inductors L1 and L2 by the flyback current is dissipated by conduction through diodes D2, DC2 and resistor R2. The value of resistor R2 is chosen to dissipate the flyback energy before State 3.

State 3. S1 is opened, S2 is closed, S3 is opened, and S4 remains open. Voltage $V_A$ at node A is brought down to Vss. Vp is now greater than $V_A$, causing negative current $I_L$ to flow proportional to the time integral of the voltage Vc across inductors L1 and L2. Once the falling voltage Vp crosses the halfway point, Vc reverses polarity and control network 922 turns on switch S4 at the negative peak of Vc at time t3. With practical circuit delays and a slow turn-on transition of S4, Vp is smoothly returned to the return potential, zero volts, prior to the current through inductors L1 and L2 reaching zero.

State 4. S1 remains open, S2 remains closed, S3 remains open, and S4 is closed. With S4 closed and the current flowing through inductors L1 and L2 approaching zero, inductors L1 and L2 see a forcing voltage of Vss minus Vp, where Vp equals zero volts due to S4. A second flyback current flows through L1 and L2, reverse biasing D2, and drawing node A down sharply, forward biasing diode DC1 and dissipating the flyback energy in resistor R1.

A second sustain driver 905 on the opposite side of the panel provides a sustain pulse that rises, discharges, and falls. S4 is part of the return path for the second sustain driver 905.

Figure 6:
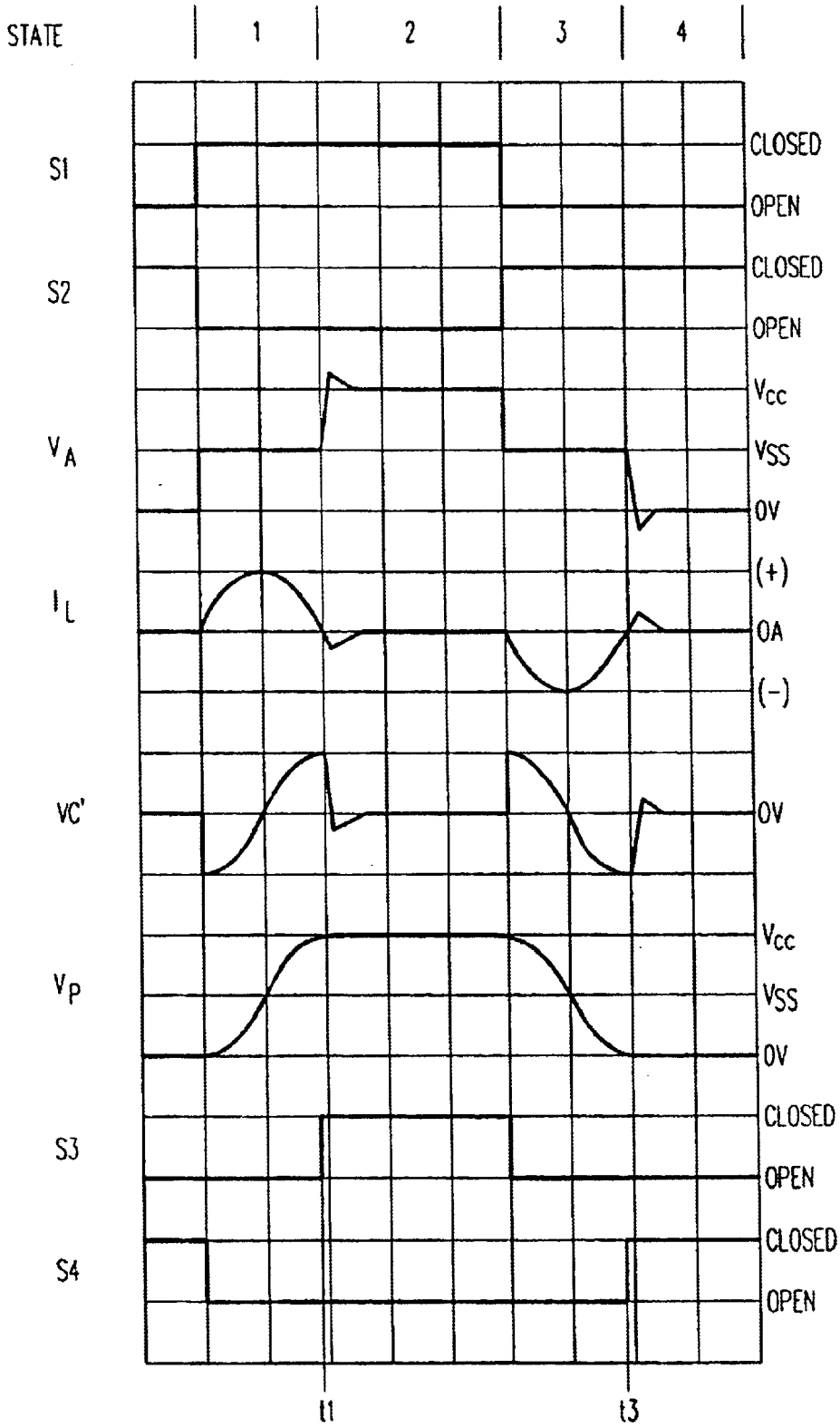
FIG. 6 (PRIOR ART)
FIG. 6 is a waveform diagram illustrating the operation of the circuit of FIG. 5.

In a comparison of the waveforms of FIG. 10 with the prior art representation of FIG. 6, note that in FIG. 10 during the falling transition of voltage Vp, voltage $V_A$ differs from that shown in FIG. 6 due to the voltage division between of L1 and L2. The secondary voltage Vc' corresponds with a reduced voltage across L1 during the transition.

Figure 11:
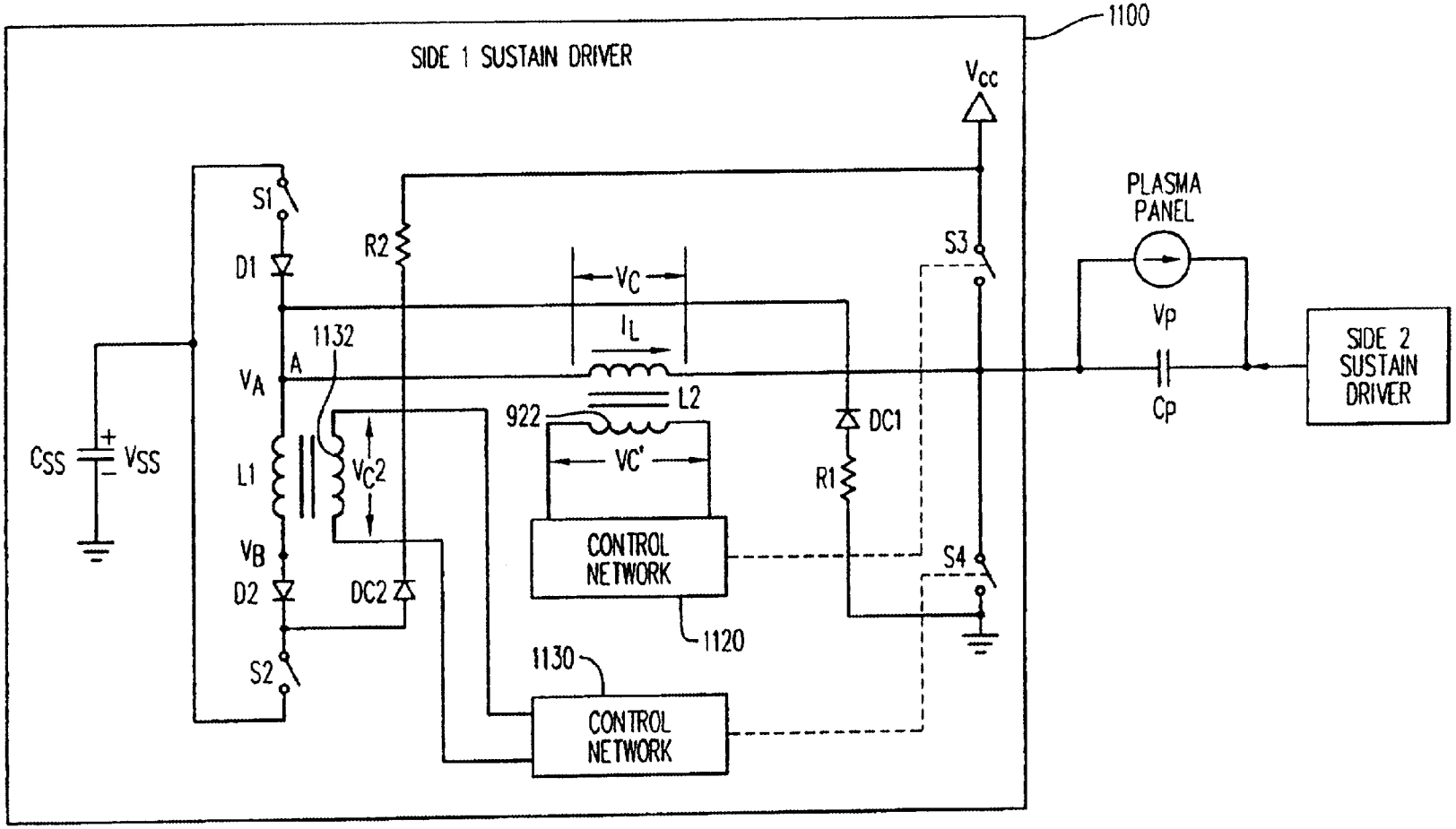
FIG. 11 is a schematic of a variation of the circuit shown in FIG. 9.

FIG. 11 is a schematic of a variation of the circuit shown in FIG. 9. A sustain driver 1100 includes winding 922 that serves as a secondary winding to L1 similarly to that of sustain driver 900 in FIG. 9. Sustain driver 1100 also includes a winding 1132, and two control networks 1120 and 1130. Winding 1132 serves as a secondary winding to inductor L2. Control network 1120 senses the voltage across winding 922 and controls the state of S3. Control network 1130 senses a voltage across secondary winding 1132 and controls S4. The availability of separate windings and control networks for the rising versus falling transitions allows for more accurate control of each transition.

Figure 12:
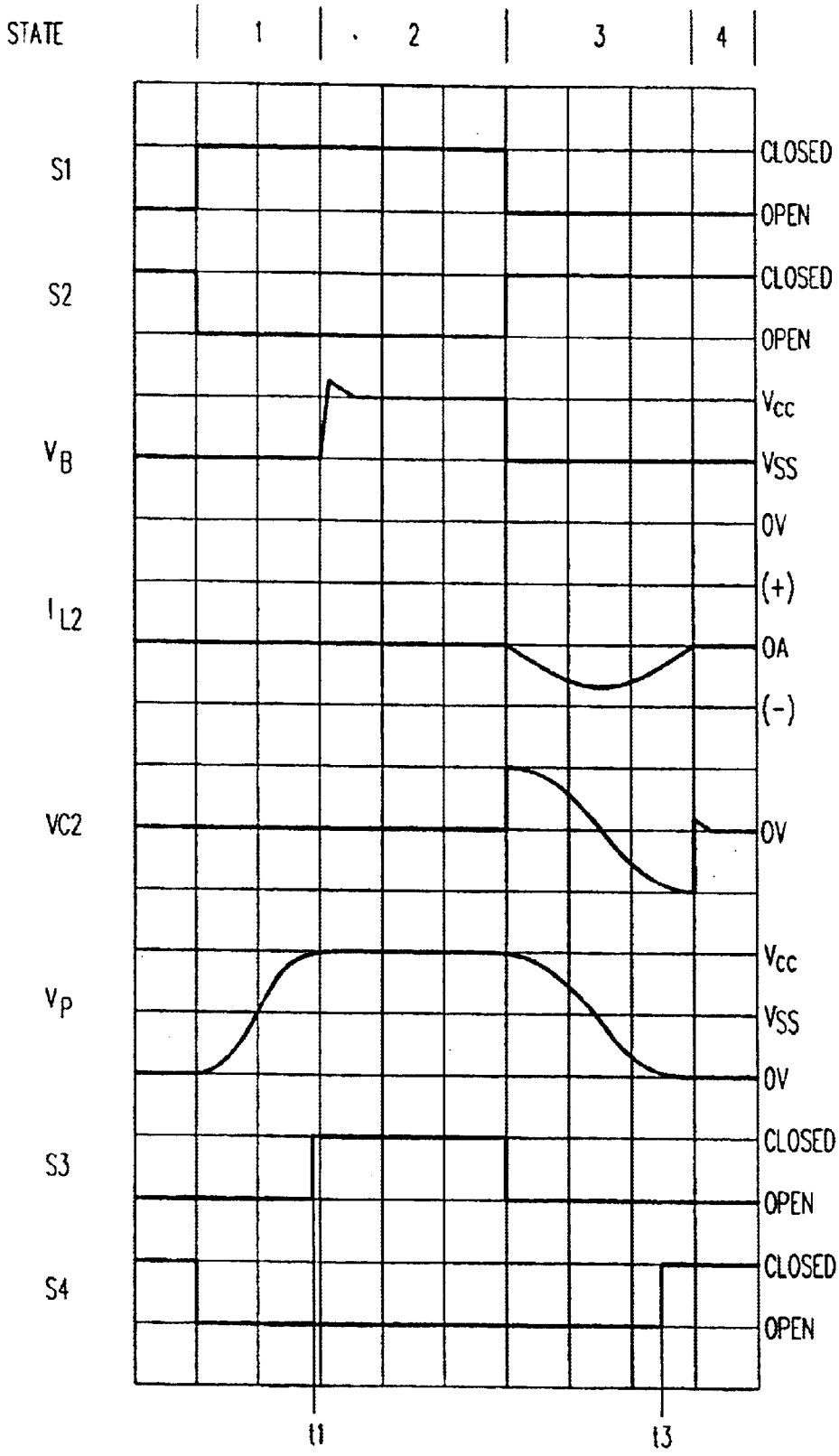
FIG. 12 is a timing diagram of the circuit shown in FIG. 11.

FIG. 12 is a timing diagram of the circuit shown in FIG. 11. The rising transition operates as stated for the circuit of FIG. 9 with waveforms shown in FIG. 10. The circuit of FIG. 9 has a limited signal voltage on Vc' during the falling transition. By placing the proper number of turns on winding 1132 on inductor L2, a voltage VC2 may be produced with an amplitude equal to that produced by winding Vc' during the rising transition.

Figure 13:
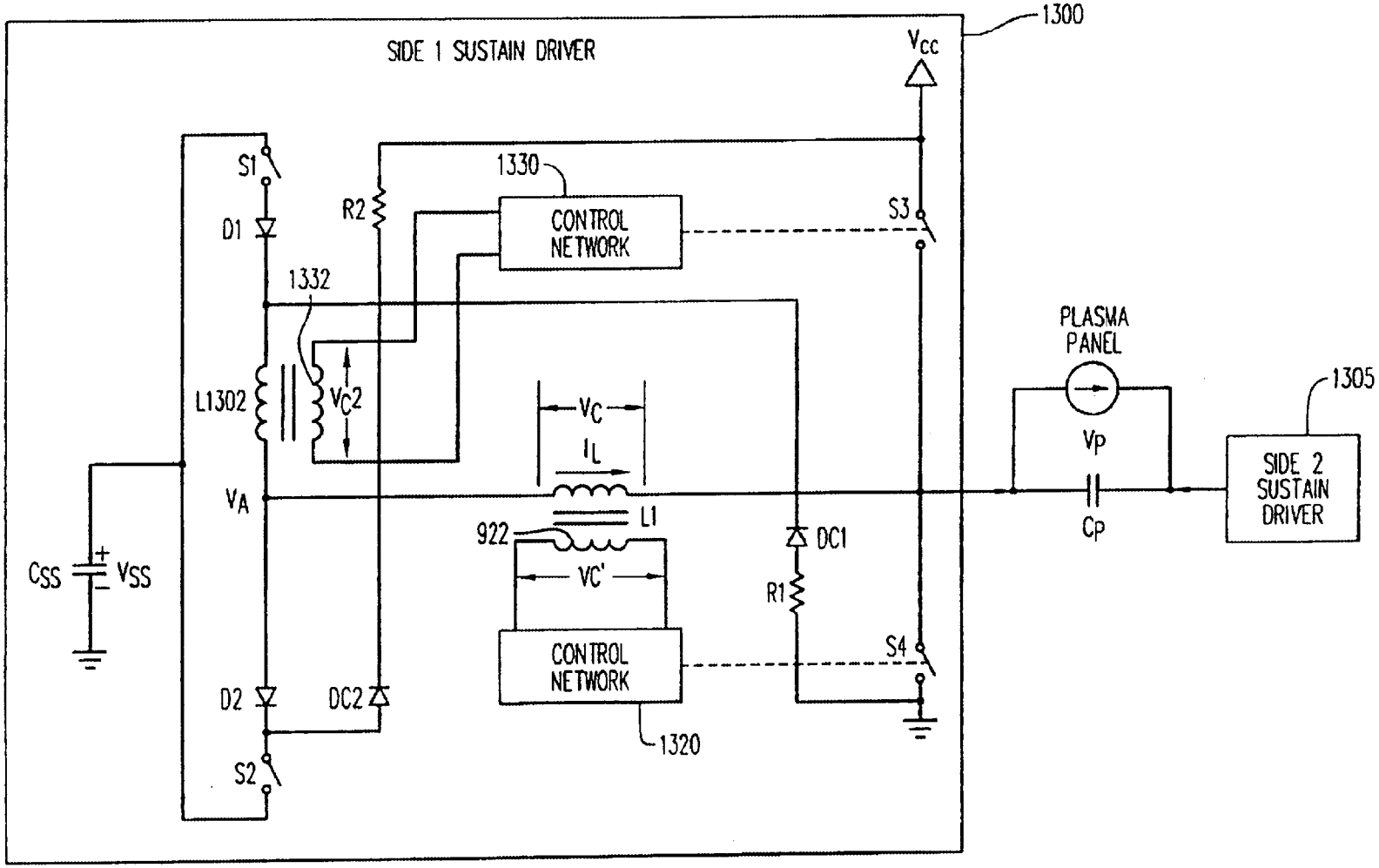
FIG. 13 is a schematic of another variation of the circuit shown in FIG. 9.

FIG. 13 is a schematic of another variation of the circuit shown in FIG. 9. A sustain driver 1300 includes two inductors, L1 and $L_{1302}$. A winding 922 serves as a secondary winding to inductor L1 and a winding 1332 serves as a secondary winding to inductor $L_{1302}$.

In comparison to the circuit in FIG. 9, sustain driver 1300 does not include an inductor L2 as shown in FIG. 9. Also, in sustain driver 1300, $L_{1302}$ is positioned between a node defined by a junction of diodes D1 and DC1, and a node defined by a junction of L1 and D2.

In this embodiment of the invention the circuit will produce a longer rising transition and a slower falling transition. This embodiment is helpful for PDP display waveforms which produce sustain discharge currents of the falling transition of the sustain pulse. In such a PDP, the opposing sustain driver makes it's falling transition and initiates a gas discharge during the high time of the reference sustainer. The opposing sustainer then rises and the reference sustainer falls, triggering the next gas discharge.

Assume that prior to State 1 a recovery voltage Vss is at Vcc/2, Vp is at zero, S1 and S3 are open, and S2 and S4 are closed.

State 1. S1 is closed, S2 is opened, S3 remains open, and S4 also opens. With S1 closed inductors L1302 and L1 with Cp form a series resonant circuit, with a "forcing" voltage of Vss applied thereto. As the panel voltage Vp rises above Vss, winding 1332 produces a voltage Vc2 to control network 1330, which closes switch S3 prior to the current flowing through inductors L1302 and L1 returning to zero.

State 2. S1 remains closed, S2 remains open, S3 remains closed, and S4 remains open. On the opposite side of the plasma panel, another sustain driver 1305, which is identical to sustain driver 1300, drives the opposite side of the panel to zero. If any pixels are "ON" then a discharge current flows through switch S3. The opposing sustain driver then transitions back to it's high level.

State 3. S1 is opened, S2 is closed, S3 is opened, and S4 remains open. With S2 closed, inductor L1 and panel capacitance Cp form a series resonant circuit with a forcing voltage, from the panel, of Vcc minus Vss. As the panel voltage Vp falls below Vss, winding 922 produces a voltage Vc' to control network 1320, which closes switch S4 prior to the current flowing through inductor L1 returning to zero.

State 4. S1 remains open, S2 remains closed, S3 remains open, and S4 remains closed. With the opposing sustain driver 1300 at a high level, a gas discharge will occur with S4 sinking the gas discharge current.

Figure 14:
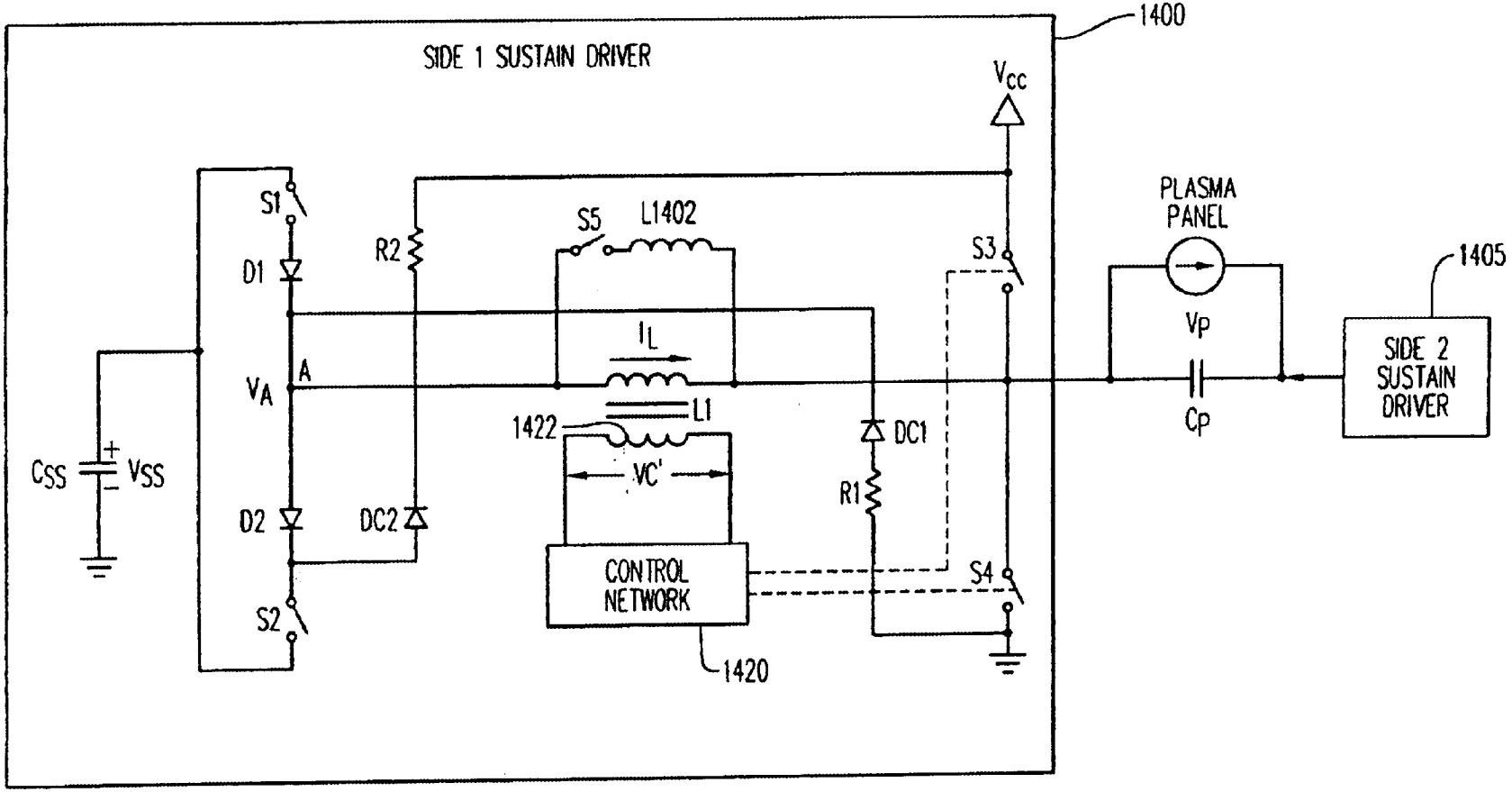
FIG. 14 is a schematic of another variation of a circuit in accordance with the present invention for providing asymmetrical rise and fall times.

FIG. 14 is a schematic of another variation of a circuit in accordance with the present invention for providing asymmetrical rise and fall times. A sustain driver 1400 includes two inductors, L1 and L1402. A switch S5 in series with L1402 enables and disables current through L1402. When S5 is closed, i.e., conducting, $L_{1402}$ is placed in parallel with L1. A winding 1422 serves as a secondary winding to inductor L1.

In this embodiment of the invention the circuit will produce a shorter rising transition or a shorter falling transition whenever S5 is closed. This embodiment is helpful for PDP display waveforms that produce sustain discharge currents at different transitions of the sustain pulse within the different waveform time periods. In such a display system, energy recovery efficiency can be maximized with a longer transition time whenever a gas discharge is not expected to occur.

Assume that prior to State 1 a recovery voltage Vss is at Vcc/2, Vp is at zero, S1 and S3 are open, and S2 and S4 are closed. The states described below will produce a faster rising transition and a slower falling transition.

State 1. S1 is closed, S2 is opened, S3 remains open, S4 is opened, and S5 is closed. With S5 closed, inductors L1 and L1402 are configured in parallel, thereby reducing the effective inductance, which forms a series resonant circuit with the panel capacitance Cp. The "forcing" voltage of Vss is applied thereto. As the panel voltage Vp rises above Vss, winding 1422 produces a voltage Vc'. The voltage Vc' is detected by a control network 1420, which closes switch S3 prior to the time when current flowing through inductors L1 and L1402 returns to zero.

State 2. S1 remains closed, S2 remains open, S3 remains closed, S4 remains open, and S5 remains closed. With S3 closed, any "ON" pixels will be discharged with current flowing through S3. As the current through inductors L1 and L1402 reaches zero, the "forcing" voltage reverses and a first flyback transition occurs forcing the voltage at node A to rise sharply. The flyback energy is then dissipated primarily in resistor R2.

State 3. S1 is opened, S2 is closed, S3 is opened, S4 remains open, and S5 is opened. With S5 open, inductor L1 forms a series resonant circuit with panel capacitance Cp, and a forcing voltage, from the panel, of Vcc minus Vss is applied thereto. As the panel voltage Vp falls below Vss, winding 1422 produces a voltage Vc' to control network 1420, which closes switch S4 prior to the time the current flowing through inductor L1 returns to zero.

State 4. S1 remains open, S2 remains closed, S3 remains open, S4 remains closed, and S5 remains open. As the current through inductor L1 reaches zero, the "forcing" voltage reverses and a second flyback transition occurs, forcing the voltage at node A to fall sharply. The flyback energy is then dissipated primarily in resistor R1. With switch S4 closed, Vp is clamped to zero, and an identical opposing sustain driver 1405 can rise to a high level and trigger a gas discharge with S4 sinking the gas discharge current.

Figure 1:
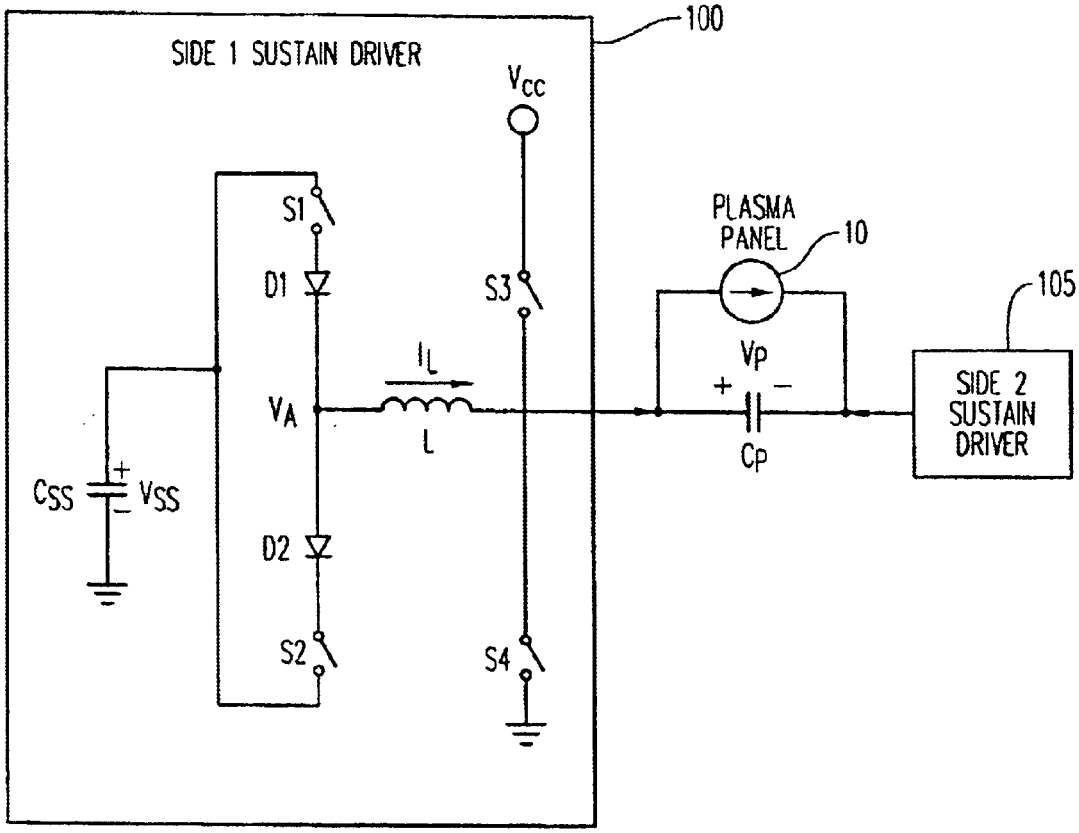
FIG. 1 (PRIOR ART)
FIG. 1 is an idealized circuit diagram of a prior art sustain driver for an AC plasma panel.
Figure 2:
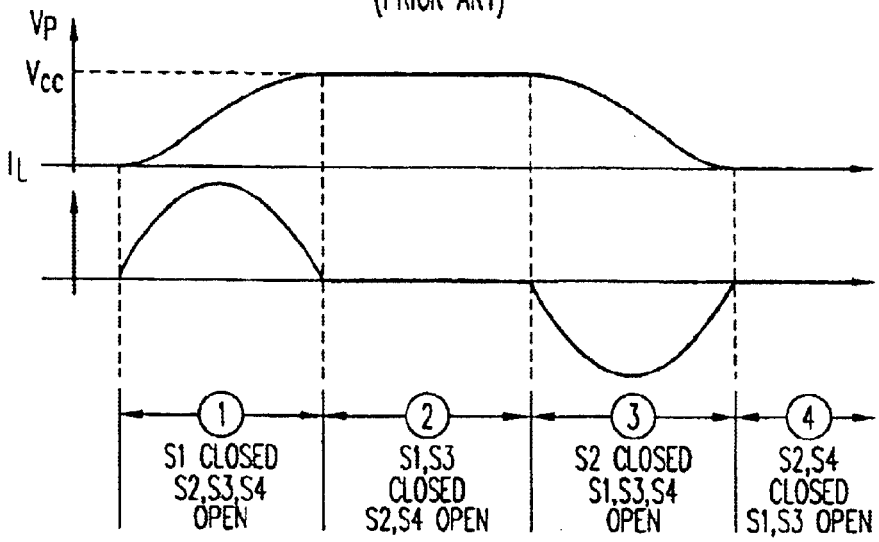
FIG. 2 (PRIOR ART)
FIG. 2 is a waveform diagram illustrating the operation of the circuit of FIG. 1.
Figure 3:
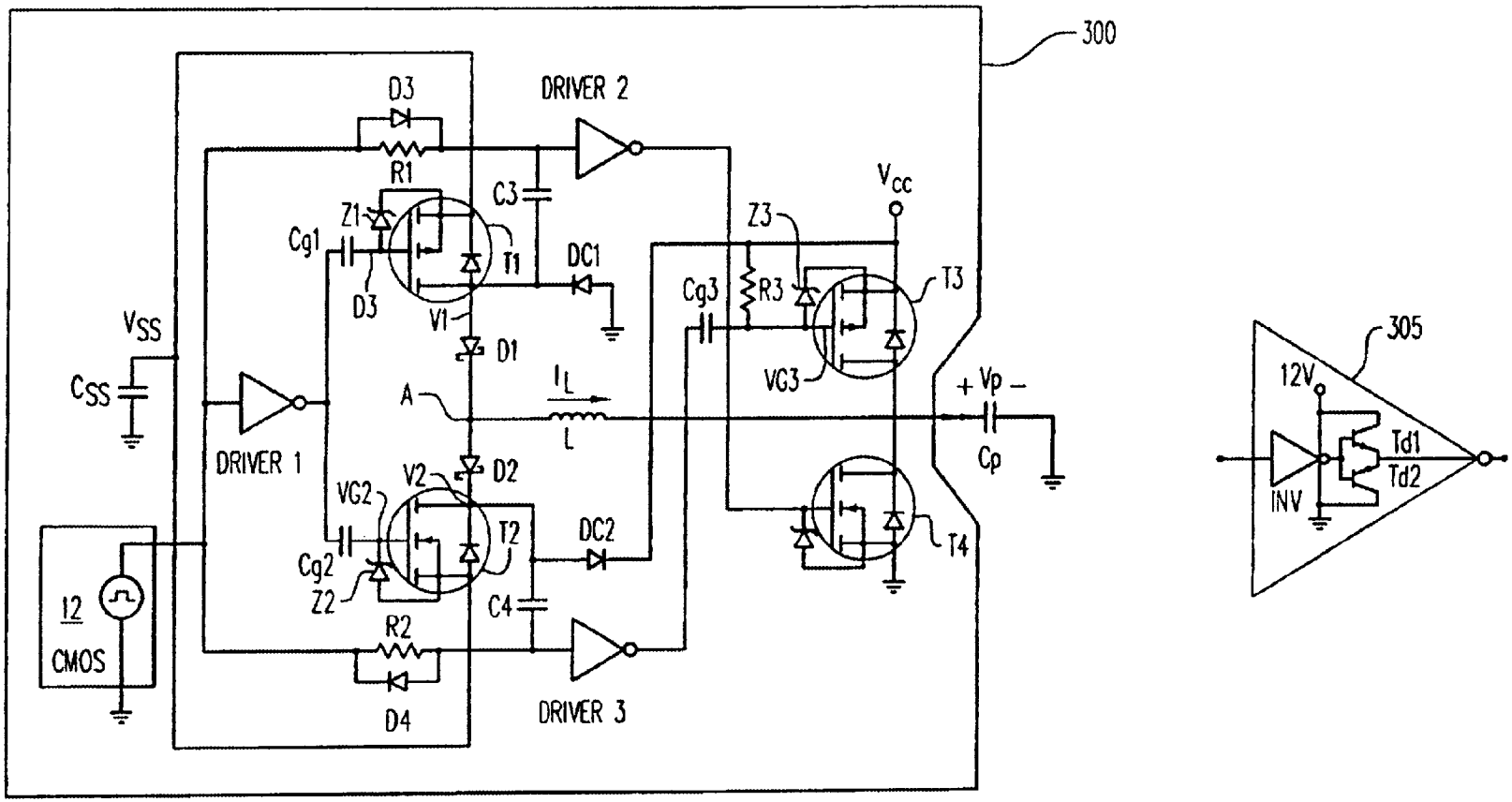
FIG. 3 (PRIOR ART)
FIG. 3 is a detailed circuit diagram of the idealized prior art sustain driver of FIG. 1.
Figure 4:
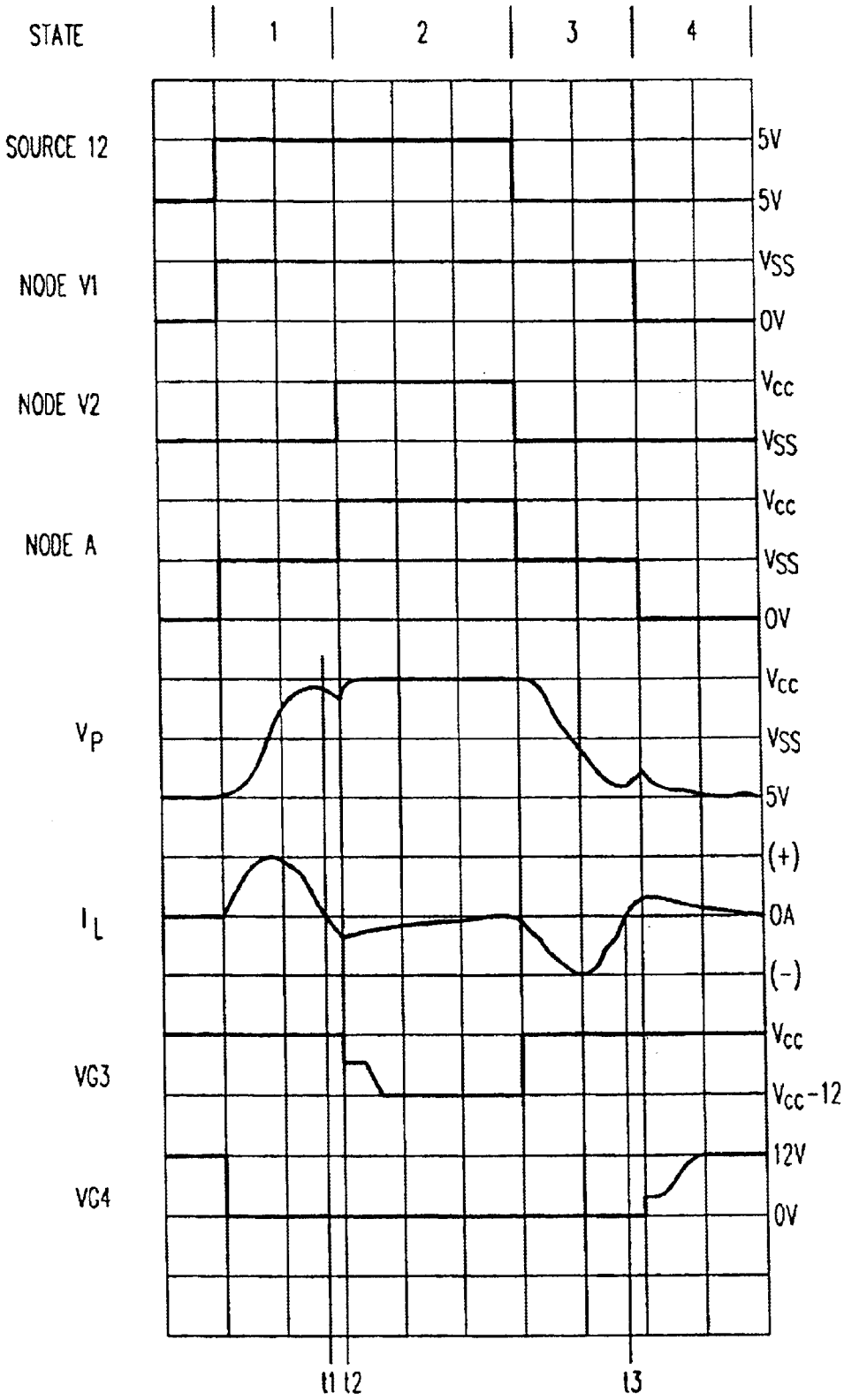
FIG. 4 (PRIOR ART)
FIG. 4 is a waveform diagram illustrating the operation of the circuit of FIG. 3.
Figure 5:
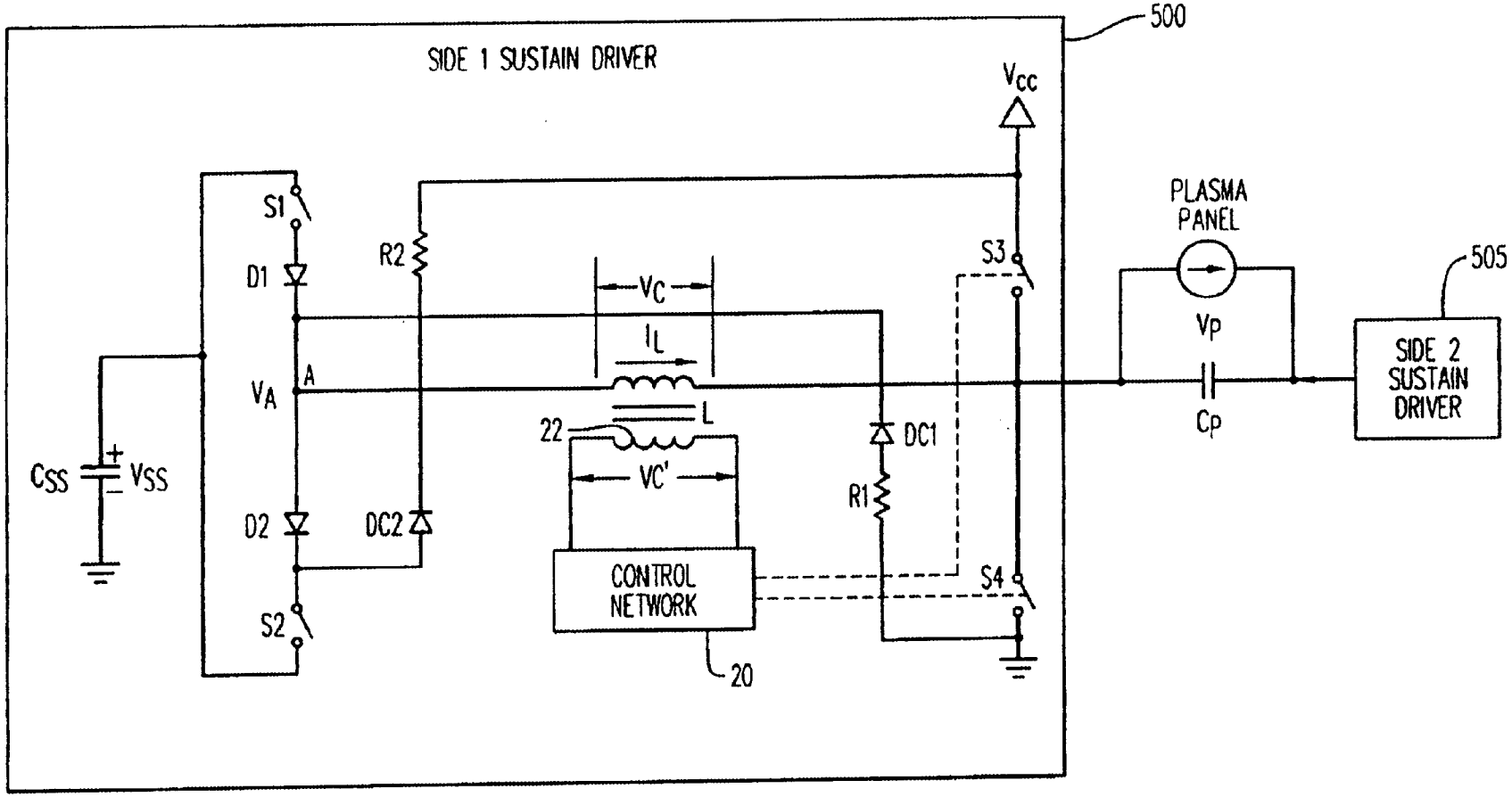
FIG. 5 (PRIOR ART)
FIG. 5 is an idealized circuit diagram of another prior art sustain driver for an AC plasma panel.

For the sake of clarity, FIGS. 7, 9, 11, 13 and 14 each represent an idealized embodiment of the present invention in which the switches S1, S2, S3, S4 and S5 are represented as mechanical devices. In a practical embodiment, each switch can be effectuated with any appropriate switching device such as a transistor (See FIG. 3) or other semiconductor device for controlling a conduction or non-conduction of current. Similarily, the embodiment of L1302 in FIG. 13 may be applied to the circuits of FIGS. 7, 9, 11 to provide a longer transition time and a shorter falling transition time in those embodiments.

It should be understood that the foregoing description is only illustrative of the invention. Various alternatives and modifications can be devised by those skilled in the art without departing from the invention. For instance, this invention is applicable to DC plasma panels, electroluminescent displays, LCD displays, or any application driving capacitive loads. The present invention is intended to embrace all such alternatives, modifications and variances that fall within the scope of the appended claims.

What is claimed is:

1. A circuit for providing a pulse to drive a capacitive load, said circuit comprising:

a first inductive component that influences both a transition time of a rising edge of said pulse and a transition time of a falling edge of said pulse; and a second inductive component that influences one of said transition time of said rising edge and said transition time of said falling edge so that said rising edge and said falling edge are asymmetrical wherein said capacitive load is a panel capacitance in a plasma display panel.

2. The circuit of claim 1, wherein said circuit is characterized by (a) a first current that flows through said first inductive component to produce one of said rising edge and said falling edge, and (b) a second current that flows through said first inductive component and said second inductive component in series to produce the other of said rising edge and said falling edge, and wherein said circuit further comprises:

a first switching device for enabling and disabling a path for said first current; and a second switching device for enabling and disabling a path for said second current.

3. The circuit of claim 1, wherein said circuit is characterized by (a) a first current that flows through said first inductive component to produce one of said rising edge and said falling edge, and (b) a second current that flows through said first inductive component and said second inductive component in parallel to produce the other of said rising edge and said falling edge, and wherein said circuit further comprises:

a first switching device for enabling and disabling a path for said first current; and a second switching device for enabling and disabling a path for said second current.

4. The circuit of claim 1, further comprising:

a switching device connectable to said capacitive load, for enabling and disabling a path from a voltage supply to said capacitive load; and a controller, responsive to a signal derived from said first inductive component, for controlling said switching device, wherein said controller controls said switching device to enable said path when a current flow through said first inductive component approaches zero.

5. The circuit of claim 1, further comprising:

a switching device connectable to said capacitive load, for enabling and disabling a path from a node of common potential to said capacitive load; and a controller responsive to a signal derived from said first inductive component, for controlling said switching device, wherein said controller controls said switching device to enable said path when a current flow through said first inductive component approaches zero.

6. The circuit of claim 1, further comprising:

a switching device connectable to said capacitive load, for enabling and disabling a path from a voltage supply to said capacitive load; and a controller responsive to a signal derived from said second inductive component, for controlling said switching device, wherein said controller controls said switching device to enable said path when a current flow through said second inductive component approaches zero.

7. The circuit of claim 1, further comprising:

a switching device connectable to said capacitive load, for enabling and disabling a conductive path from a node of common potential to said capacitive load; and a controller responsive to a signal derived from said second inductive component, for controlling said switching device, wherein said controller controls said switching device to enable said conductive path when a current flow through said second inductive component approaches zero.

8. A circuit for providing a sustain pulse to drive a capacitive load in a plasma display panel, said circuit comprising:

a first inductor;

a second inductor;

a first transistor for enabling and disabling a path for a first current through said first inductor to produce a rising edge of said pulse;

a second transistor for enabling and disabling a path for a second current through said first inductor and said second inductor in series to produce a falling edge of said pulse;

wherein said rising edge and said falling edge are asymmetrical.

9. The circuit of claim 8, further comprising a third transistor connectable to said capacitive load, for enabling and disabling a path from a voltage supply to said capacitive load.

10. The circuit of claim 9, further comprising a controller responsive to a signal derived from said first inductor, for controlling said third transistor, wherein said controller controls said third transistor to enable said path when a current flow through said first inductor approaches zero.

11. The circuit of claim 9, further comprising a controller responsive to a signal derived from said second inductor, for controlling said third transistor, wherein said controller controls said third transistor to enable said path when a current flow through said second inductor approaches zero.

12. The circuit of claim 8, further comprising a third transistor connectable to said capacitive load, for enabling and disabling a path from a node of common potential to said capacitive load.

13. The circuit of claim 12, further comprising a controller responsive to a signal derived from said first inductor, for controlling said third transistor, wherein said controller controls said third transistor to enable said path when a current flow through said first inductor approaches zero.

14. The circuit of claim 12, further comprising a controller responsive to a signal derived from said second inductor, for controlling said third transistor, wherein said controller controls said third transistor to enable said path when a current flow through said second inductor approaches zero.

15. A circuit for providing a driving pulse to a display panel having panel electrodes and panel capacitance, said circuit comprising:

a first inductor that influences both a transition time of a rising edge of said pulse and a transition time of a falling edge of said pulse, said first inductor having a first terminal and a second terminal, said second terminal connectable to said panel electrodes;

a driving voltage source for providing a driving voltage referenced to a common potential;

a voltage supply for providing a supply voltage referenced to said common potential, wherein said supply voltage is of a magnitude that is greater than said driving voltage;

a first switching device for enabling and disabling a conductive path from said driving voltage source to said first terminal in response to an input signal transition, said input signal transition commencing a first state wherein, during an enabling of said conductive path, a current flow occurs through said first inductor to charge said panel capacitance, said first inductor causing said panel electrodes to achieve a voltage magnitude in excess of said driving voltage, prior to said current flow reaching zero;

a second switching device, connectable to said panel electrodes, for enabling and disabling a conductive path from said voltage supply to said second terminal and said panel electrodes;

a switch control coupled to said first inductor and responsive to said current flow therein, said switch control operative during at least a portion of said first state to control said second switching device to disable conduction therethrough, and thereafter in response to a signal derived from said first inductor, to control said second switching device to enable conduction therethrough a time prior to said current flow reaching zero, whereby said voltage supply means, during a succeeding second state, supplies current to both said panel electrodes and flyback current to said first inductor; and a second inductor that influences one of said transition time of said rising edge and said transition time of said falling edge so that said rising edge and said falling edge are asymmetrical.

* * * * *